United States Patent [19]

Chaney et al.

[11] 4,211,491

[45] Jul. 8, 1980

[54] COVERED MIXING MACHINE, OR THE LIKE, AND METHOD OF LOADING THE SAME

[75] Inventors: Robert F. Chaney; Gene N. Connell, both of San Francisco, Calif.

[73] Assignee: Quad C Corporation, San Francisco, Calif.

[21] Appl. No.: 959,692

[22] Filed: Nov. 13, 1978

[51] Int. Cl.[2] ..... B28C 5/06

[52] U.S. Cl. ..... 366/30; 366/46; 220/254

[58] Field of Search ..... 366/30, 32, 45–48; 215/235, 236; 217/76, 81, 83, 124; 220/200, 254, 259, 361, 365

[56] References Cited

U.S. PATENT DOCUMENTS

| | | | |
|---|---|---|---|
| 868,821 | 10/1907 | Stephenson | 220/254 |
| 1,842,794 | 1/1932 | Masury | 220/254 |
| 1,942,277 | 1/1934 | Davis et al. | 366/45 |
| 2,571,113 | 10/1951 | Crosby | 366/30 |
| 2,746,734 | 5/1956 | Hilkemeier | 366/44 |

FOREIGN PATENT DOCUMENTS

| | | | |
|---|---|---|---|
| 690370 | 4/1953 | United Kingdom | 366/45 |

*Primary Examiner*—Leonard D. Christian
*Attorney, Agent, or Firm*—Victor R. Beckman

[57] ABSTRACT

A machine for mixing fireproofing material, concrete or the like includes a cylindrical shaped rotatable drum with a rotatably driven axial shaft having mixer blades attached to the shaft. The drum has an opening for loading and discharging material to be mixed and a pivotally mounted cover for closing the opening. The cover is provided with an aperture and a funnel-shaped member within the aperture for supporting a sack of material to be emptied into the drum. The funnel-shaped member is closed by the sack supported therein thus sealing the aperture during the sack emptying and material mixing processes. Liquid is supplied to the mixer drum through another opening in the cover, which opening is blocked in the mixing position of the drum to prevent the emission of dust particles therethrough. Latching means are provided for releasably securing the cover means in closed or partially open position, to facilitate cleaning of the mixing drum. Also, the cover means and a handle for rotating the mixing drum support the cover in the event the latching means is unlatched when the drum is rotated to the dumping position.

19 Claims, 8 Drawing Figures

FIG-4
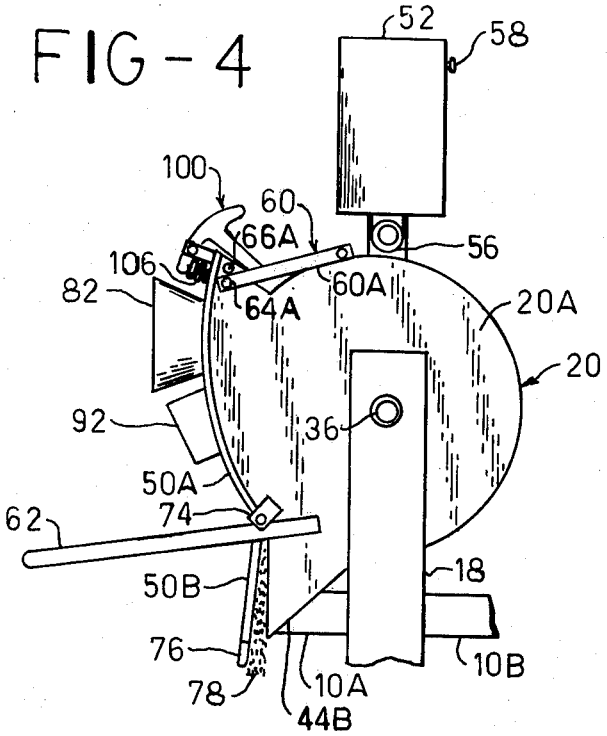
FIG-5
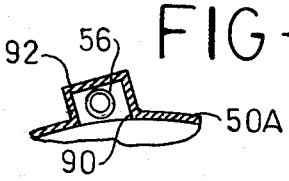
FIG-6
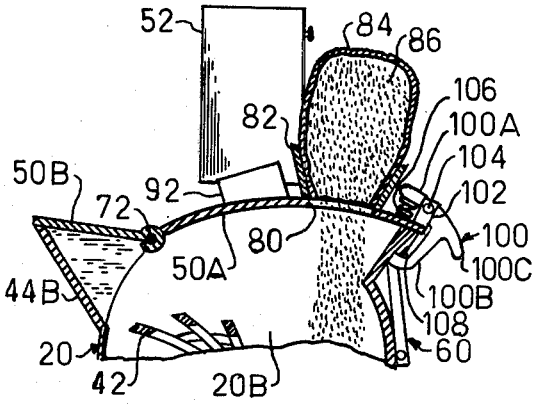
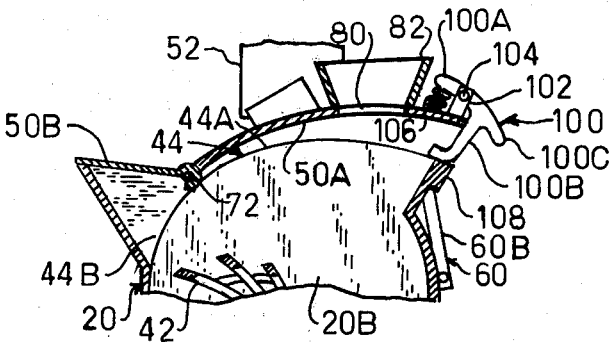
FIG-7
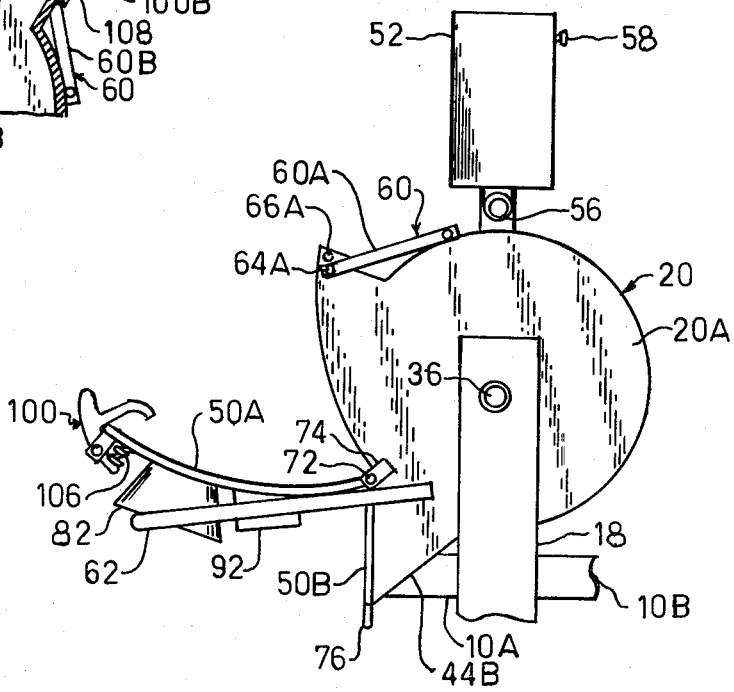
FIG-8

COVERED MIXING MACHINE, OR THE LIKE, AND METHOD OF LOADING THE SAME

BACKGROUND OF THE INVENTION

Mixing machines for use in mixing fireproofing material, concrete, plaster, and the like, are well known and often include a generally cylindrical-shaped mixing drum mounted for pivotal rotation about a generally horizontal axis between normal and dumping positions. A shaft with attached mixer blades extends along the horizontal pivot axis of the mixer drum, which shaft is rotatably driven for rotation of the mixer blades for mixing of the drum contents. Opening means are formed at the upper wall of the drum through which the material to be mixed is dumped into the mixer drum, and from which the mix is discharged. After mixing of the material with liquid, the mixing drum is pivoted to dumping position for dumping the mix through the discharge opening. An open net or grill structure sometimes is used to cover the opening means in the drum to prevent the operator from engaging the mixer blades with his hands while still allowing material to be dumped into the mixing drum and mixed material to be discharged therefrom. The disclosure contained in U.S. Pat. No. 2,987,302 by P. A. Terry et al exemplifies one prior art mixing machine of this general type.

A major problem with prior art mixing machines, including the Terry et al machine, is that clouds of dust particles issue from the machine as the contents of the sacks of material to be mixed are dumped into the mixer drum, and during the mixing process. The surrounding atmosphere is contaminated with the material, imperiling the health of persons breathing the same, including that of the mixer operator. Often the mixer operator is required to wear an air-filtering mask to limit the amount of material inhaled, and strict standards promulgated under the Occupational Safety and Health Act drastically limit exposure of workers to such hazards.

SUMMARY OF THE INVENTION

An object of this invention is the provision of improved mixing method and means which avoid the above and other shortcomings and deficiencies of prior art mixing machines and methods.

An object of this invention is the provision of an improved cover for a mixing machine, or the like, which greatly limits escape into the atmosphere of particles of material dumped into said machine.

An object of this invention is the provision of method and means for emptying bags, or sacks, of material into a container, such as a mixer, without substantial contamination of the surrounding area with dust-like material which normally escapes during the sack emptying and mixing processes.

An object of this invention is the provision of an improved cover latching mechanism for mixing machine covers, or the like, which serves to securely latch the in closed position in one position, and which functions to hold the cover slightly open in another position to facilitate cleaning of the interior of the machine.

An object of this invention is the provision of safety stop means for a mixing machine cover for the protection of an operator's hand against injury in event the cover inadvertently swings open while pivoting the mixing drum of the machine into dumping position.

An object of this invention is the provision of an improved liquid supply means for a mixing machine for limiting the discharge of particles of material therethrough.

The above and other objects and advantages are achieved by use of solid cover means attached to a mixing drum or container into which powder-like material is dumped from bags or sacks of material. The cover substantially covers opening means in the drum through which material is entered and discharged from the drum. The cover means is formed with an elongated aperture and an elongated funnel-shaped member thereat for the support of a bag or sack of material to be dumped into the drum or container. The sack is slit open along one edge and inserted into the funnel-shaped member to substantially completely close off the elongated aperture thereby preventing dust and particles of said material from discharging into the atmosphere through said aperture. Latching means serves to lock at least a portion of the cover means in closed cover position, and in the unlatched position serves to hold the same slightly open to facilitate hosing out the mixing drum to clean the same. Liquid, such as water, is entered into the mixing means through a flexible hose and an opening in the cover means which is substantially blocked by the hose in the normal mixing position of the drum and cover. Also, the cover is engagable with a handle attached to the drum for rotating the same such that the handle also functions as a cover stop. With this arrangement, harm to the operator is avoided in the event the drum is rotated to dumping position by use of the handle without the cover first being securely latched.

The invention will be better understood from the following detailed description thereof considered with the accompanying drawings.

BRIEF DESCRIPTION OF THE DRAWINGS

In the drawings, wherein like reference characters refer to the same parts in the several views:

FIG. 4 is a fragmentary front end view of the mixing machine similar to that of FIG. 3 but showing the mixing drum pivoted to mix dumping position;

FIG. 5 is a fragmentary sectional view taken along line 5—5 of FIG. 2 showing the liquid inlet for the cover, FIG. 6 is a fragmentary sectional view taken along line 6—6 of FIG. 2 and showing a sack of material being dumped into the mixing machine;

FIG. 7 is a fragmentary view which is similar to that of FIG. 6 without the showing of a sack but showing the cover held open in a slightly raised position by means of the cover latching mechanism; and FIG. 8 is a fragmentary front end view which is similar to that of FIG. 4 but showing the cover in fully open position supported by a handle attached to the mixing drum.

DETAILED DESCRIPTION

Figure 3:
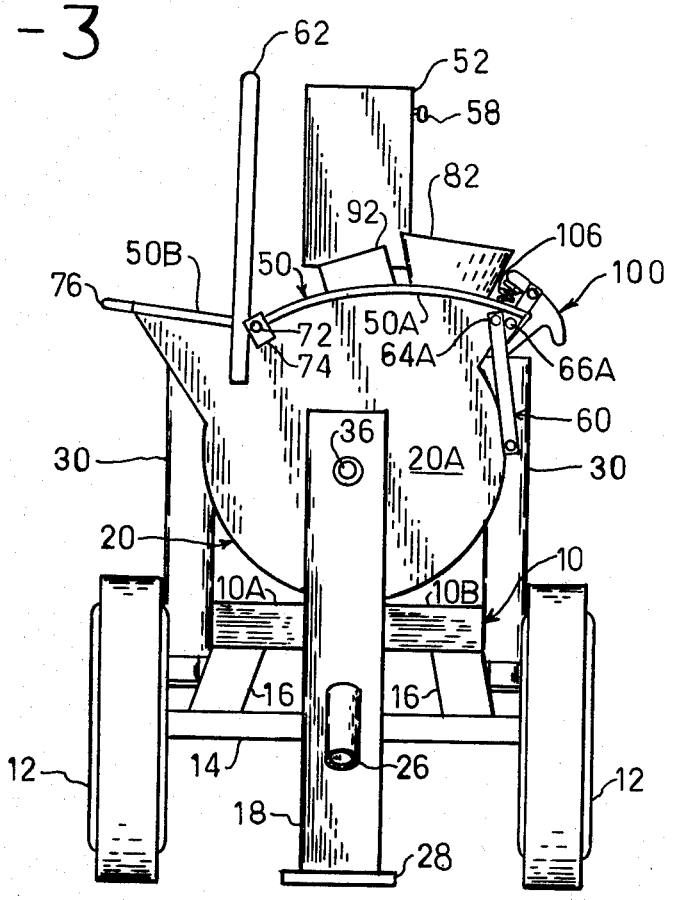
FIG. 3 is a front end view of the mixing machine.

For purposes of illustration, the invention is shown incorporated in a portable mixing machine for use in mixing plaster, concrete, fireproofing material, of the like. The illustrated mixing machine includes a frame 10 adapted for support on wheels 12, 12 mounted on an axle 14 attached to the frame by brackets 16,16 seen in FIG. 3. The frame includes generally longitudinally extending right and left side frame members 10A and 10B which angle inwardly toward the front of the machine. An upright supporting member 18 is welded to the front of the frame members 10A and 10B, and a mixing drum 20 is pivotally mounted between the supporting member 18 at the front end and supporting means 22 at the rear thereof. The rear supporting means 22 is attached to the frame members 10A and 10B and extends upwardly therefrom.

A draw bar 26 attached to the front supporting member 18 and frame 10 provides means for towing the mixing machine to and from work sites. The downwardly extending portion of the upright supporting member 18 comprises a leg for the support of the mixing machine when in operation. An enlarged foot 28 at the bottom of the leg provides for stable support thereof. Preferably, the leg section beneath the draw bar 26 is hinged to allow for the folding thereof during towing, and latch means are included to releasably secure the leg in either the raised or lowered position. Such hinged leg with latching means are well known and require no showing herein. Often, for use at a work site, the wheels 12,12 are removed and the rear end of the mixing machine is supported on extensible legs 30,30 at opposite sides of the frame. In the drawings, the telescopic legs are shown in retracted position for towing of the mixing machine.

An engine and transmission located within housing 34 at the rear of the frame 10 are operatively coupled to the mixer through a shaft 36 journaled in bearings 38,38 attached to the front and rear supporting means 18 and 22, respectively. The mixer drum 20 is provided with bearings 40,40 attached to the front and rear end walls 20A and 20B, respectively, of the drum for the rotatable support thereof on the shaft 36. Mixing blades 42 are attached to the shaft 36 within the mixing drum 20 for mixing of material within the drum upon rotation of the shaft 36 by the engine.

The upper wall of the mixing drum is formed with opening means, identified generally by reference character 44, described in greater detail below. The opening means 44 includes outwardly, flared loading and discharge sections 44A and 44B along opposite sides of the mixing drum through which material to be mixed is introduced into the drum and from which the mix is discharged, respectively. Liquid, such as water, for the mix is introduced through the loading opening section 44A from a liquid storage tank 52 carried on brackets 54 above the engine housing 34. A flexible hose 56 provides fluid communication between the storage tank and drum opening. It will be understood that a measured amount of liquid is introduced into the mixer drum 20 through the hose 56 upon actuation of control valve handle 58 at the storage tank. Additionally, means, not shown, connect the tank to a liquid supply source for supplying the tank with liquid as measured amounts thereof are drained therefrom. Such liquid supply means, including mechanism for supplying a measured amount of liquid upon actuation of the control valve handle 58 are well known and require no further detailed description. In the illustrated arrangement, the outer free end of the flexible hose 56 terminates above the mixing drum opening 44A for passage of liquid from the storage tank 52 into the mixer drum through the hose 56 whenever the control valve handle 58 is actuated.

Figure 1:
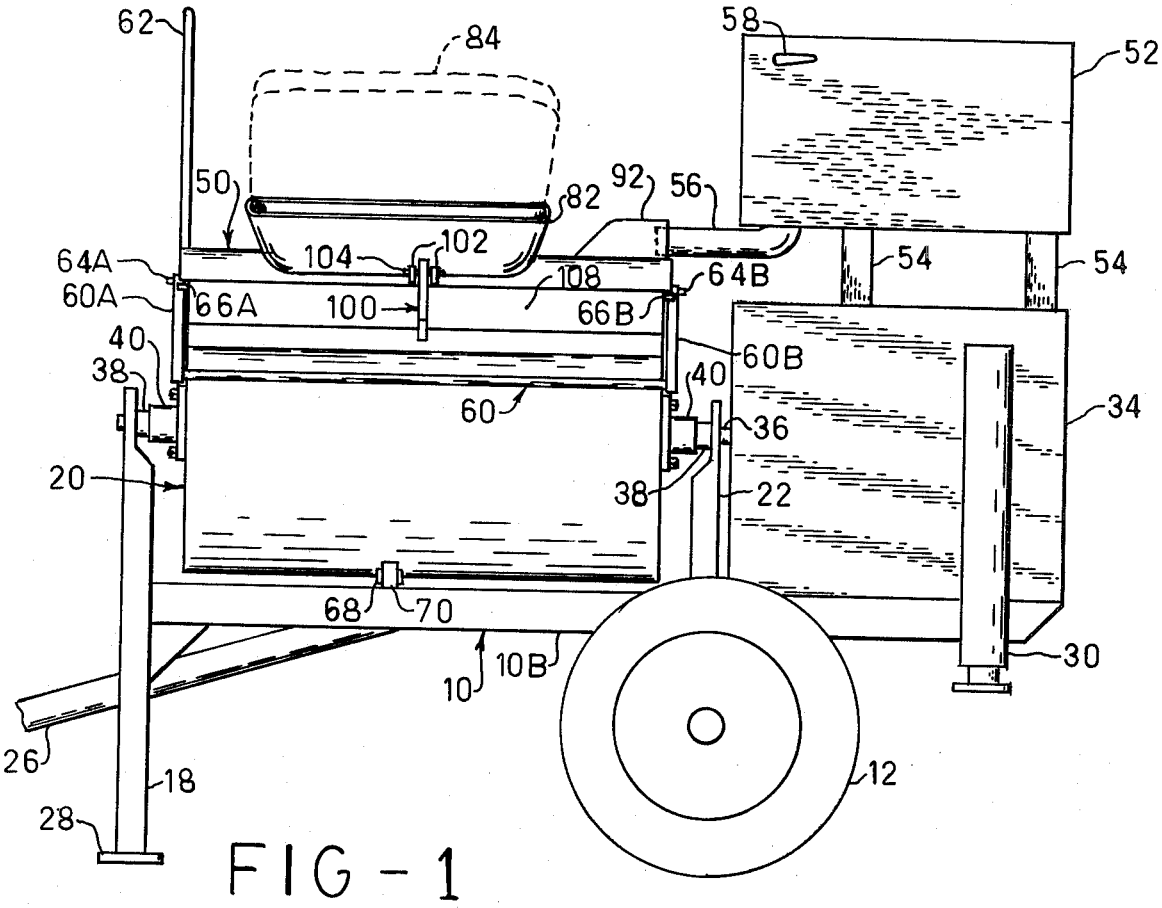
FIG. 1 is a side elevational view of a mixing machine which includes cover means embodying this invention.

To dump the mix, the mixing drum 20 is rotated in a counterclockwise direction, as viewed from the front, into a dumping position illustrated in FIG. 4. To facilitate rotation of the mixing drum from either side thereof, handles 60 and 62 are provided at opposite sides thereof. The handle 60 is pivotally attached to the mixing drum ends 20A and 20B by pivot pins 64A and 64B extending from the respective drum ends, which pins extend through clearance holes formed in handle brackets 60A and 60B at opposite ends of the handle. Stop pins 66A and 66B on the drum ends are engaged by the handle brackets 60A and 60B, respectively, when the handle 60 is raised for rotation of the mixer drum in the counterclockwise direction for dumping the mix. The other handle 62, which is operable from the other side of the mixing machine, simply comprises an elongated lever attached as by welding to the front end wall 20A of the mixing drum and extending generally radially therefrom. Rotation in clockwise direction of the mixing drum is limited by a stop member 68 secured to the drum and engagable with a cooperating stop member 70 attached to the frame section 10B, as seen in FIG. 1. In the dumping position, shown in FIGS. 4 and 8, counterclockwise rotation of the mixing drum is limited by engagement of the discharge spout 44B with the right frame member 10A.

The mixing machine described thus far is of substantially conventional design. If desired, a hopper may be located beneath the mixing drum to receive mix therefrom in the manner shown in the above-mentioned Terry et al U.S. Pat. No. 2,987,302.

The cover means 50 of this invention comprises separate cover sections 50A and 50B for closing the respective loading and discharge sections 44A and 44B of the drum opening 44. A pivot pin 72 carried by generally radially extending brackets 74,74 affixed to the opposite ends 20A and 20B of the mixing drum hingedly supports the cover sections 50A and 50B along a common pivot axis. Obviously, separate pivot pins may be employed for the individual cover sections in a slightly modified arrangement wherein the space between the such hinge pins is closed by a solid mixer drum section. In the illustrated arrangement, the cover section 50B for closing the discharge spout of the mixer drum simply comprises a flat elongated member with a handle 76 opposite the hinged edge to facilitate opening and closing the same, as desired. It will be understood that the cover section 50B normally remains closed in the mixing position of the mixing drum (shown in FIGS. 1–3, 6 and 7), and is free to swing open for the discharge of mix 78 from the discharge spout when the mixing drum is rotated counterclockwise into the discharge position illustrated in FIG. 4.

Figure 2:
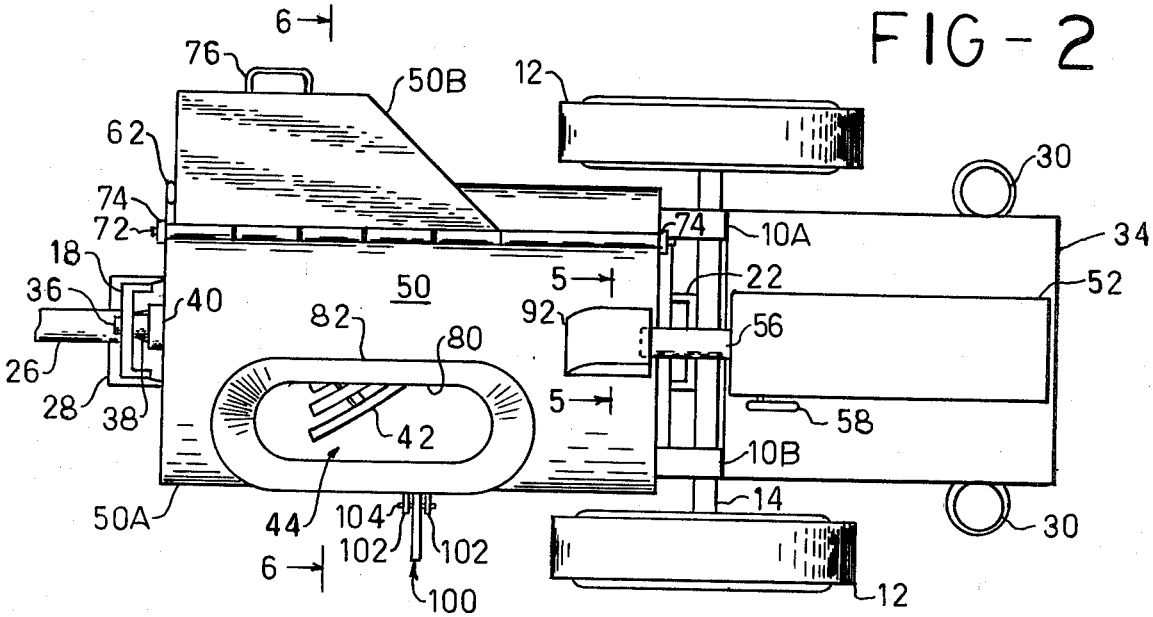
FIG. 2 is a plan view of the mixing machine shown in FIG. 1.

The other cover section 50A also is formed of solid material, and is convexly curved to engage edges of the loading opening 44A of the mixing drum. In accordance with one aspect of the present invention, an elongated aperture 80, shown in FIGS. 2, 6 and 7, is formed in the solid cover section 50A along the longitudinal free edge thereof, and an elongated funnel-shaped member 82 is attached to the cover section at said aperture. The funnel-shaped member 82 is dimensioned, constructed, and arranged to support a bag, or sack, 84 of material 86 to be dumped into the mixer drum in manner shown in full line in FIG. 6 and broken line in FIG. 1. In the illustrated arrangement the funnel-shaped member 82 extends outwardly from the cover section, but it will be apparent that it may extend inwardly thereof, or may be intermediately positioned with a portion extending inwardly and a portion outwardly of the cover. In any event, ample clearance between the mixer blades 42 and funnel-shaped member 82, or sack support therein, is required. The sack 84 not only is supported by the funnel-shaped member 82, but circumferentially, or peripherally engages said member to block the aperture thereby preventing dust and dust-like particles of material being dumped into the mixer drum, and material already contained therein, from escaping therethrough and into the surrounding atmosphere. With prior art arrangements wherein sacks of dry material are dumped into the mixer drum through an open loading opening, or one covered with an open grill or metal slats, hugh clouds of particles issue from the mixer drum. Often the dust particles are harmful to the operator's health, and respiratory filters commonly worn by the operator do not always provide adequate protection against such harm. Furthermore, other workers in the vicinity of the mixing machine also are exposed to such particles. With the present arrangement the escape of particles of material into the atmosphere may be greatly reduced and substantially eliminated.

As noted above, a measured amount of liquid, such as water, is introduced into the mixing drum from the storage tank 52 through the flexible hose 56 upon actuation of the control valve handle 58. As seen in FIG. 5, an opening, or cut-out, 90 is formed at the rear edge of the cover section 50A, which opening is located beneath the hose 56 end with the cover section closed and the mixing drum in upright mixing position. Shield, or deflector, means 92 is attached to the cover at the opening 90. The illustrated shield extends upwardly from the cover and is open at the rear thereof to receive the hose 56. Liquid issuing from the hose is deflected into the mixing drum by the shield. Additionally, the shield with the hose end extend thereinto, at least partially blocks, or closes, the opening 90 to limit the escape of particles of material therethrough. (Obviously, the cover could be provided with a funnel-shaped member for reception of the hose end in sealing engagement therewith to further seal the interior of the mixer drum from the surrounding atmosphere.) The hose 56 is flexible and of such a length relative to the deflector to allow for bending necessary for the entry of the hose end into and out of the opening 90 when the drum is pivoted into and out of the upright mixing position.

The cover section 50A is releasably held in a closed position by a releasable latching mechanism 100 of novel design. Referring to FIGS. 1, 6 and 7, the latching mechanism is shown pivotally attached to the cover by a pair of spaced brackets 102, 102 welded or otherwise suitably secured to the cover, and a pivot pin 104 extending between the brackets and through an aperture in the latch positioned between the brackets. The latch includes an arm section 100A which extends over the cover, and between the end of which arm section and cover a compression spring 106 is located for resiliently biasing the latching mechanism in a clockwise direction as viewed from the front of the mixing machine. Also included is a generally downwardly extending hook and cover-support arm, or section, 100B, which is adapted for locking engagement with a flange 108 formed along the longitudinally extending edge of the opening 44A in the closed condition of the cover section 50A. An actuating arm, or handle, section 100C also is provided for use in pivoting the latching arm against the action of the spring 106 when opening or closing the cover section.

The arm 100B of the latching mechanism serves a second purpose, i.e. that of supporting the cover section 50A in a slightly raised, open, position as shown in FIG. 7. When the handle 100C is released, the cover is raised, the mechanism is resiliently biased in a clockwise direction to a position wherein the arm 100B engages the edge of the cover section 50A, at which point the lower end of the arm 100B is adapted to rest upon the flange 108 to support the cover section in the partially open position illustrated in FIG. 7. The nozzle of a hose may be inserted through the opening so provided to facilitate hosing down the interior of the mixing drum for cleaning the same between batches, or as required.

Another aspect of the present invention includes the use of the lever, or handle, 62 as a stop for the cover section 50A to limit the open position thereof. As best seen in FIG. 8, the cover section 50A and handle 62 are so constructed and arranged such that at least a portion of the cover section 50A overlies the handle 62 for the support thereof by the handle in the open position of the cover. In the illustrated arrangement, at least a portion of the forward edge of the cover section 50A extends forwardly of the drum end 20A to overlie the handle 60 which is welded to and extends generally radially of the end 20A. The forward extension of the cover section 50A to substantially the plane of the forward face of the handle 62 is illustrated in FIGS. 1 and 2. In the illustrated arrangement, the bracket 74 attached to the front end 20A of the drum for support of the cover pivot pin 72 is L-shaped to allow for such forward extension of the cover section 50A. As best seen in FIG. 8, the outer free end of the lever, or handle, 62 is protected from the cover section 50A due to the curvature of the door section away from the handle end. Now, if the operator were to inadvertently rotate the mixing drum to dumping position by use of the handle 62 while the cover section was in an unlatched condition, his hand would be protected from the swinging cover section by engagement of the cover section with the handle before striking his hand.

Although the operation of the mixing machine is believed to be apparent from the above description, a brief description of the operation thereof now will be given. The liquid storage tank 52 is supplied with a suitable liquid, such as water. The cover sections 50A and 50B are closed, the mixing drum is rotated to the upright mixing position illustrated in FIGS. 1–3, and the engine is operated for rotation of the shaft 36 and attached mixing blades 42. A sack 84 of material 86 to be mixed with liquid from the tank 52 is slit open along one edge thereof in preparation for dumping. Generally, immediately prior to dumping, the control valve handle 58 is actuated to start the flow of liquid into the mixing drum 20 through the flexible tube 56. While the liquid is flowing, the sack 84 is placed into the funnel-like member 82 with the slit side down for the flow of material 86 into the mixing drum, as shown in FIG. 6. The sack 84 substantially seals off the aperture at the funnel-shaped member 82 to prevent dust and other such particles of the material from escaping therethrough. The cover sections 50A and 50B substantially close off the respective loading and discharge portions 44A and 44B of the mixing drum opening means 44 to confine the material within the drum. The sack 84 is left in the funnel member 82 during mixing until another sack of material is to be emptied into the mixer or drum or the mix is to be dumped. To dump the mix the mixing drum is rotated in a counterclockwise direction by use of either handle 60 or 62 for passage of the mix from the discharge spout or opening 44B in the manner shown in FIG. 4. After dumping, the mixing drum is returned to the upright mixing position. If desired, the cover section 50A may be opened slightly to the position illustrated in FIG. 7 for cleaning the interior of the mixing drum and blades with a stream of water from a hose, or the like, not shown. The cover section 50A is reclosed and the excess water dumped from the mixing drum before the next batch is to be mixed.

The invention having been described in detail in accordance with requirements of the Patent Statutes, various changes and modifications will suggest themselves to those skilled in this art. As noted above, the invention is not limited to use in mixing any particular type of material, or materials. Also, the cover means with the funnel-shaped sack-supporting member may be used with numerous other machines to which sacks of material are supplied including, for example, powder feeders, hoppers, and the like, for controlling the emission of clouds of material which issue during such dumping and during operation of the machine. In addition, as noted above, the deflector 92 and associated cover opening 90 may include, or be replaced by, a funnel-shaped member adapted to receive the end of a flexible liquid supply tube in engagement therewith to further seal such opening in the upright mixing position of the mixing drum. Also, as mentioned above, a bag slitter of any well known type, such as a power driven blade, may be included at the funnel-shaped member 82. With such an arrangement, unslit sacks of material may be disposed in the funnel-shaped member and the slitting means then operated to slit open the bag for dumping of the contents. Bag, or sack, slitting means are well known and require no detailed description. Additionally, a grill, screen, slats, or the like, may be included at mixing drum aperture 44; at both the loading and discharge areas thereof, to prevent the entry of the operator's hand into the mixing drum. The use of such a protective screen or grill at the cover apertures 80 and 90 also is contemplated. Protective screens and grills are well known and the use herein requires no further detail. In the illustrated arrangement, the front edge of the cover section 50A overhangs the mixing drum 20 for engagement with the handle 62 welded to the front wall 20A of the mixing drum. As noted above, the handle 62 simply may include a rearwardly extending or rearwardly offset portion which extends rearwardly of the front of wall 20A to engage the cover section 50A in the open position thereof to eliminate the need for the cover section overhang. It is intended that the above and other such changes and modifications shall fall within the spirit and scope of the invention as defined in the appended claims.

We claim:

1. A mixing machine comprising,
supporting means,
a mixing drum,
means for mounting said mixing drum on said supporting means for pivotal rotation about a generally horizontal axis,
rotatable mixer blades within said mixing drum for mixing material contained therein,
opening means formed in said mixing drum through which dry material to be mixed may be loaded into said mixing drum,
cover means of solid material attached to said mixing drum for closing said opening means,
an aperture formed in said cover means through which dry material to be mixed may be fed into the mixing drum, and
means for substantially preventing particles of material from discharging from said mixing drum through said aperture while material to be mixed is fed therethrough.

2. The mixing machine as defined in claim 1 wherein said preventing means includes a funnel-shaped member at said aperture formed in said cover means for support of a sack of material to be mixed for closure of said aperture to the surrounding atmosphere.

3. The mixing machine as defined in claim 2 wherein said funnel-shaped member extends outwardly from said cover means.

4. The mixing machine as defined in claim 1 wherein said cover means includes first and second solid cover sections pivotally attached to said mixing drum for closing respective loading and discharge sections of said mixing drum opening means.

5. The mixing machine as defined in claim 4 including means for pivotally attaching said first and second cover sections to said mixing drum for pivotal movement about a common pivot axis.

6. The mixing machine as defined in claim 1 including,
means for pivotally attaching said cover means to said mixing drum, and
latching mechanism attached to said cover means including a resiliently biased arm engageable with said mixing drum and movable between a first position for locking said cover means in a closed position and a second position for supporting said cover means in a slightly raised open position.

7. The mixing machine as defined in claim 1 including,
combination cover stop means and handle attached to a wall of said mixing drum and extending generally radially thereof for use in rotating said mixing drum between upright mixing and pivoted dumping positions, and for support of said cover means in the full open position thereof with said mixer drum rotated into dumping position.

8. The mixing machine as defined in claim 1 including,
a flexible liquid supply tube having a discharge end positioned over said mixing drum,
means forming a liquid-receiving aperture in said cover means,
hose receiving means at said liquid-receiver aperture for receiving said discharge end of said flexible liquid supply tube when the mixing drum is in an upright mixing position and said cover means is in a closed position for substantially preventing particles of material in said mixing drum from discharging through said liquid-receiving aperture in said mixing position of said mixing drum.

9. A method of emptying a sack, bag, or the like, of dry material into a container without the escape of large amounts of said dry material from said container during dumping, said method including,
covering said container with a solid cover formed with an aperture and a unitary funnel-shaped member at said aperture,
supporting said sack of material in said funnel-shaped member for discharge of the sack contents through said aperture into said container while substantially closing said aperture to the surrounding environment by said sack supported in said funnel-shaped member.

10. A mixing machine as defined in claim 2 wherein said aperture formed in said cover means is of an elongated shape, and said funnel-shaped member has an elongated cross-sectional shape similar to said elongated shaped aperture formed in said cover.

11. A mixing machine as defined in claim 2 wherein said funnel-shaped member has an elongated cross-sectional shape and comprises, a pair of spaced opposite elongated, generally plane, side members joined by a pair of opposite generally truncated semi-conical shaped end members.

12. A mixing machine as defined in claim 2 wherein said funnel-shaped member has a cross-sectional shape similar to that of a side of a sack of material to be mixed for sealing engagement between the funnel-shaped member and sack supported on its side therein.

13. A method as defined in claim 9 wherein said funnel-shaped member has an elongated cross-sectional shape of decreasing size in going from the top to the bottom thereof, and which includes, discharging the sack contents through a slit in a downwardly-facing side of the sack within the funnel-shaped member.

14. A cover of solid material for covering a material loading opening formed in a container such as a mixer, hopper, or the like, comprising an aperture formed in said cover, and an elongated funnel-shaped member at said aperture for receiving a sack of material therein which substantially completely blocks the same preventing particles of material within said container from escaping therethrough and into the atmosphere, said elongated funnel-shaped member having an elongated cross-sectional shape of decreasing size in going downwardly along said member for support of the sack received therein, with a perimenter of the sack in engagement with walls of the funnel-shaped member.

15. A cover as defined in claim 14 wherein said funnel-shaped member comprises a pair of spaced opposite elongated generally plane side wall members joined by a pair of opposite generally truncated semi-conical shaped end wall members.

16. A cover for a mixer, or the like, to prevent dust particles of material dumped into the mixer from escaping through a material loading opening in the mixer into the surrounding atmosphere while material is being dumped from a sack into the mixer through the material loading opening, said cover comprising, a cover member of solid material attached to the mixer for closing the material loading opening therein, an aperture formed in said cover member through which dry material to be mixed may be dumped from a sack into the mixer, and a funnel-shaped member at said aperture into which a sack to be emptied fits in substantially sealing engagement therewith for plugging said aperture by the sack and preventing escape of particles of material into the surrounding atmosphere through said aperture.

17. A cover as defined in claim 16 wherein said funnel-shaped member has an elongated cross-sectional shape of decreasing size in going from the top to the bottom thereof, which shape is similar to that of the periphery of a side of the sack fitting in said funnel-shaped member for substantial sealing engagement along said periphery with said funnel-shaped member.

18. A method of dumping dry material from a sack into a mixer, or the like, of the type which includes a solid mixer cover having an elongated aperture formed therein and a funnel-shaped member at said aperture having an elongated cross-sectional shape of decreasing size in going from the top to the bottom thereof, said method comprising, opening a sack of material to be dumped into the mixer along one elongated face of the sack, and placing the sack into the funnel-shaped member with the opening facing downwardly and the periphery of the opened face in substantially sealing engagement with the funnel-shaped member for plugging the mixer cover aperture while dumping the sack contents into the mixer and preventing particles of material from exiting the mixer therethrough.

19. A method as defined in claim 18 wherein the step of opening the sack comprises slitting open the same.

* * * * *